US005423628A

United States Patent [19]

Jaworski

[11] Patent Number: 5,423,628

[45] Date of Patent: Jun. 13, 1995

[54] WINCH CONSTRUCTION FOR A VIBRATORY CONCRETE SCREED

[75] Inventor: Brian P. Jaworski, West Bend, Wis.

[73] Assignee: M-B-W Inc., Slinger, Wis.

[21] Appl. No.: 267,153

[22] Filed: Jun. 28, 1994

[51] Int. Cl.[6] ..... E01C 19/22

[52] U.S. Cl. ..... 404/114; 404/119

[58] Field of Search ..... 475/162, 178, 343; 404/96, 114, 118, 119, 120

[56] References Cited

U.S. PATENT DOCUMENTS

| | | | |
|---|---|---|---|
| 4,712,450 | 12/1987 | Takamiya et al. | 475/343 X |
| 4,758,114 | 7/1988 | Artzberger | 404/119 |
| 4,898,065 | 2/1990 | Ogata et al. | 475/178 X |
| 5,030,184 | 7/1991 | Rennerfelt | 475/162 |
| 5,324,240 | 6/1994 | Guttinger | 475/162 |

*Primary Examiner*—William P. Neuder

*Attorney, Agent, or Firm*—Andrus, Sceales, Starke & Sawall

[57] ABSTRACT

A winch assembly is connected to each end of a vibratory concrete screed to move the screed across a concrete slab to be finished. Each winch assembly includes a rotatable drum with a cable wound on the drum. The free end of each cable is connected to a fixed object mounted along the side of the concrete slab. To wind the cable on the drum and move the screed along the slab, the eccentric drive shaft of the screed is connected through a variable speed belt drive to the respective drum. Each belt drive includes an adjusting mechanism for varying the effective diameter of a belt drive pulley, thus providing a variation in speed. Each winch assembly also includes an eccentric gear speed reducing mechanism, which is connected between the belt drive and the drum to further reduce the output speed to the cable drum.

14 Claims, 3 Drawing Sheets

53
48
48a
47
46
46
44
11
61
71
72
74
75
29
30
32
78
60
28
42
33
34
19
1
40
20
20
22
21
19
17
18
16
5
8
54
7
2
37
38
15
8
4
14
12
13
6
3
2
2

26
15
28
25
23
27
24
22
17
28
16
15

FIG. 2
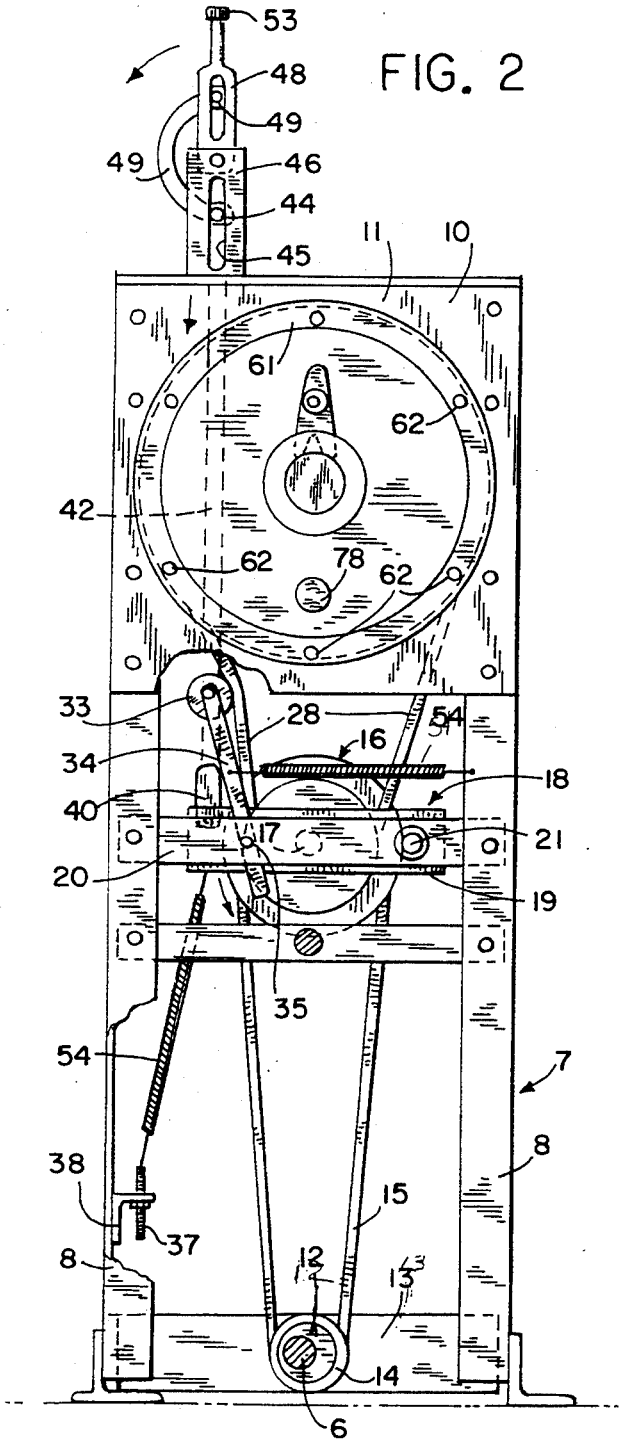
FIG. 4
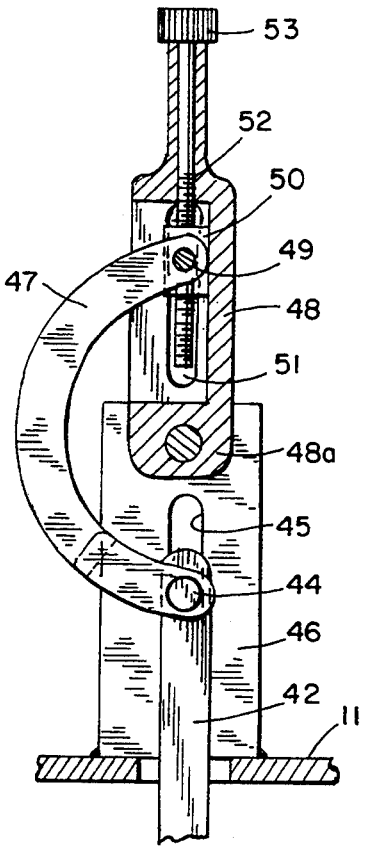
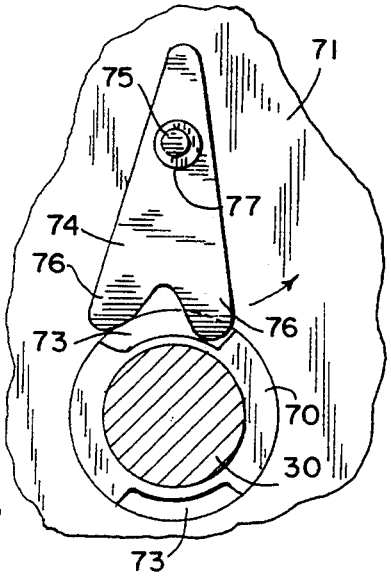
FIG. 7

WINCH CONSTRUCTION FOR A VIBRATORY CONCRETE SCREED

BACKGROUND OF THE INVENTION

Vibratory screeds are frequently employed to impart vibrations to poured concrete for tamping and leveling of a concrete slab as it is finished. The screed eliminates the tedious manual labor involved in finishing the concrete, thereby increasing productivity in laying of the concrete. In addition, the screed improves the quality of the finished concrete slab by providing more accurately controlled slab surfaces, as well as controlling the crown.

U.S. Pat. No. 4,758,114 discloses a vibratory concrete screed, and as shown in that patent, a winch is mounted on each end of the screed and a cable is wound on the drum of each winch with the free end of each cable being attached to a stake or fixed object along the side of the concrete slab. By rotating each drum, the cable is wound on the drum to thereby move or traverse the screed along the concrete slab.

While it would be desirable to continuously move the screed along the concrete slab at a fixed rate of speed, in practice, the screed is normally moved in a start and stop manner. It is further desired that the speed of travel have "memory" so that when the movement is started it will be at the same speed as previously used.

In the past, screeds have been manually operated using an operator at each winch. More recently, power operated winches have been employed, in which the power for operation of the winches is taken off of the vibratory eccentric shaft of the screed. However, with a power take-off system, an extensive speed reduction mechanism is required, because the vibratory eccentric shaft is normally operating at a speed of about 2500 rpm, while the winch cable drum rotates at a speed of about 10 to 15 rpm.

With one type of power operated winch, power is taken off the eccentric shaft to drive a hydraulic pump, which in turn operates hydraulic motors that are connected to the winch cable drums. However, hydraulic systems of this type are expensive and have a relatively slow reaction in starting and stopping. There is also a potential of oil leaks from the hydraulic system onto the concrete surface which would destroy the surface characteristics of the concrete.

Other types of power driven winches have used expensive gear trains or variable speed transmissions in order to achieve the desired speed reduction to the winch cable drum.

SUMMARY OF THE INVENTION

The invention is directed to an improved power operated winch assembly for a vibratory concrete screed. The winch assembly is mounted to an end of the screed and includes a first pulley which is connected to the vibratory eccentric drive shaft of the screed. The first pulley is connected through a V-belt drive to a double pulley unit that is mounted on a pivotable carriage. The double pulley unit is composed of a pair of outer pulley members and a central pulley member, which is slidable toward and away from the outer pulley members. The space between one of the outer pulley members and the central pulley member defines a first diverging groove that receives the first V-belt, while the space between the second of the outer pulley members and the central pulley member defines a second diverging groove. A second V-belt is received within the second groove and is connected to an output pulley that is mounted in axial alignment with the winch cable drum.

As a feature of the invention, the carriage which carries the double pulley unit, is pivoted relative to the frame of the winch assembly through operation of a hand lever. By pivoting the carriage in one direction, the first belt will slacken to disengage the drive to the winch cable drum, while pivoting the carriage in the opposite direction will effect engagement of the drive.

The belt drive also includes an adjusting mechanism through which the pivotal movement of the carriage can be varied to thereby establish a desired output speed for the belt drive. By setting the pivotal movement of the carriage, the effective diameters of the two pulleys in the double pulley unit are correspondingly established to thereby provide a desired output speed for the belt drive.

As a further aspect of the invention, a novel speed reducing mechanism is utilized between the output of belt drive and the winch drum. The belt drive serves to drive a cam or eccentric which is journaled within a central opening in a pinion gear that is mounted for rotation within a larger toothed aperture in a gear ring. Rotation of the cam causes the pinion gear to slowly "walk" around the interior of the gear ring. The gear ring carries a plurality of followers which are connected to a rotatable plate, and the plate, in turn, is connected to the winch drum. This mechanism provides a substantial reduction in speed from the belt drive to the winch drum, so that the screed will move at a rate of about 3 ft. to 8 ft. per minute.

The winch mechanism of the invention provides a relatively quick start and stop action and has a memory adjustment, so that when the drive is engaged the winch drum will rotate at the same speed. This is important because on a given job site using concrete of the same consistency, it is desirable to have the same speed of travel when the drive is engaged.

The winch construction of the invention is of simple construction and eliminates the expensive gear trains and variable speed transmissions as used in the past.

Other objects and advantages will appear during the course of the following description.

DESCRIPTION OF THE DRAWINGS

The drawings illustrate the best mode presently contemplated of carrying out the invention.

In the drawings:

FIG. 2 is a view taken along line 2—2 of FIG. 1.

FIG. 4 is an enlarged fragmentary front elevation of the speed adjusting mechanism with parts broken away in section;

FIG. 6 is a view taken along line 6—6 of FIG. 5; and

DESCRIPTION OF THE ILLUSTRATED EMBODIMENT

Figure 1:
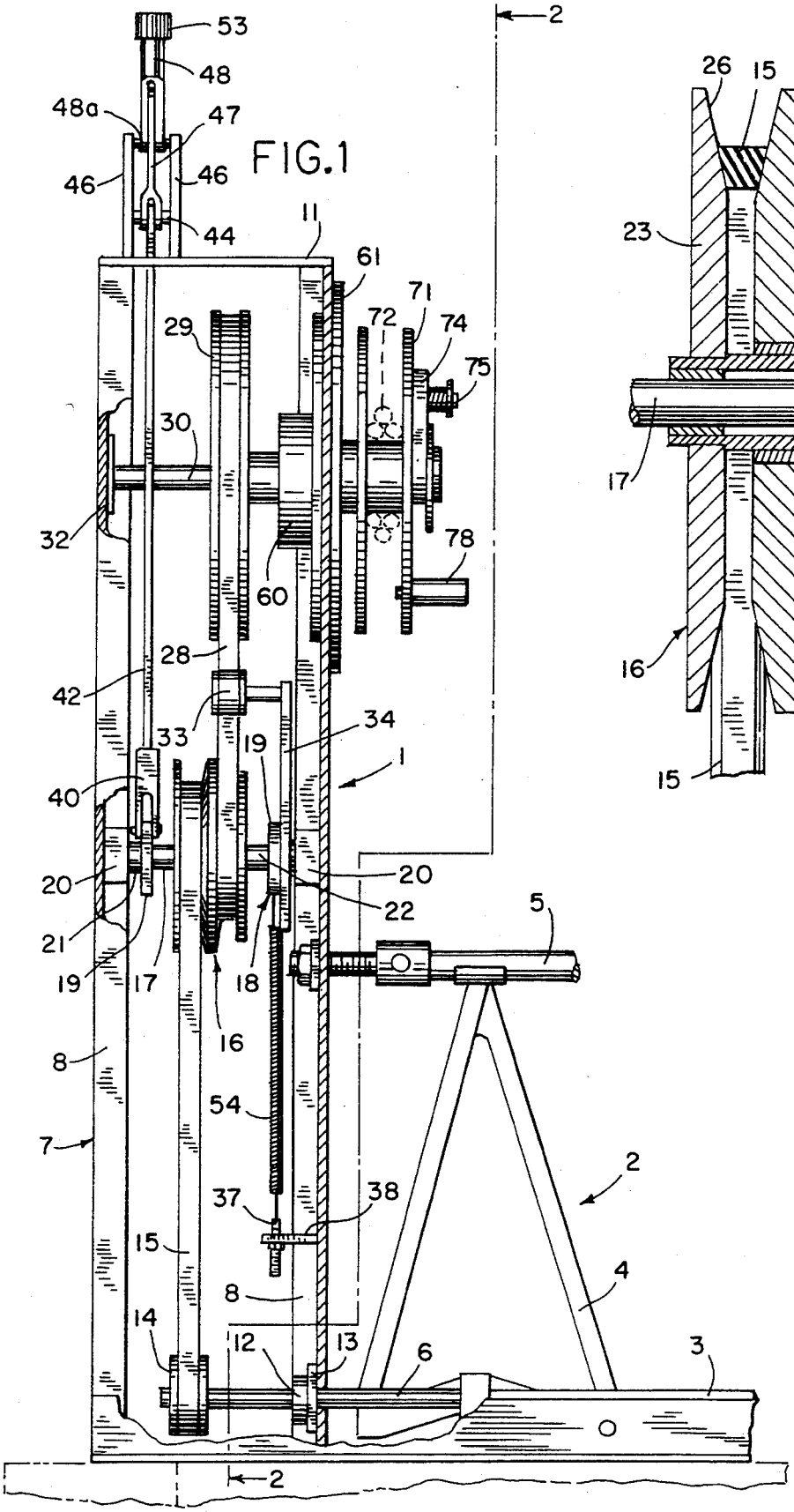
FIG. 1 is a front elevation of the winch construction of the invention as associated with a vibratory screed.

FIG. 1 illustrates a winch assembly 1 connected to the end of a vibratory concrete screed 2 and utilized for the purpose of moving or traversing the screed along a concrete slab to be finished. In practice, a winch assembly 1 would be associated with each end of the screed and would be operated in synchronization to move the screed along the slab.

The screed can be constructed in a manner described in U.S. Pat. No. 4,758,114, and includes a pair of angle shaped screed plates 3, which extend longitudinally of the screed and are adapted to engage and finish the surface of the concrete slab.

Screed plates 3 are interconnected by a series of generally triangular frame members 4. Each frame member 4 extends at an angle to adjacent frame members and adjacent ends of the frame members are connected together, as described in the aforementioned patent. The upper ends of the frame members 4 can be connected together by a ridge tube 5.

To provide vibratory motion for the screed, an eccentric drive shaft 6 is journaled within the base portion of each frame member 4, and a gasoline engine (not shown) is mounted on the screed and is operably connected to the shaft 6 to drive the shaft.

Each winch assembly 1 consists of a frame 7, including angle shaped vertical corner members 8, which are connected by a front plate 10, and top plate 11, and screed plates 3.

As shown in FIG. 1, an end of the eccentric drive shaft 6 is journaled within bearing 12, mounted on the cross-plate 13, and shaft 6 carries a pulley 14. An endless V-belt 15 interconnects pulley 14 with a double pulley unit 16, that is located centrally of the height of the winch frame 7. Double pulley unit 16 includes a horizontal shaft 17 which is journaled in a carriage 18. Carriage 18 is composed of a pair of side plates 19, the ends of which are pivoted to frame members 20 by pivot shaft 21. The ends of frame members 20 are connected to corner member 8. With this construction, carriage 18, as well as the double pulley unit 16, can be pivoted about the axis of the pivot shaft 21.

Figure 3:
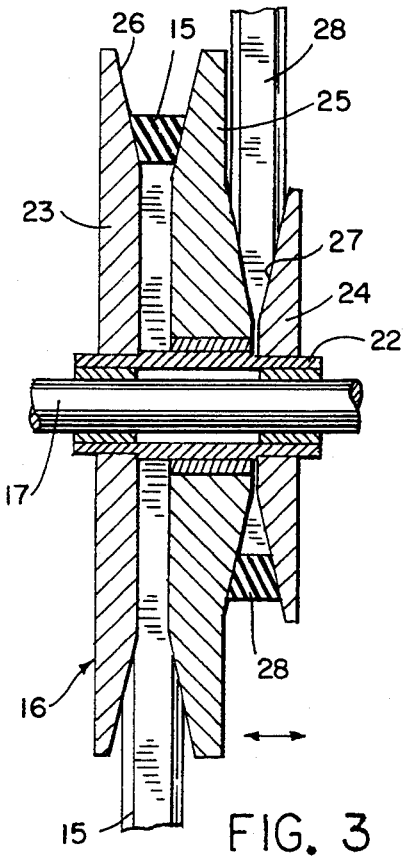
FIG. 3 is an enlarged longitudinal section of the double pulley unit.

As best seen in FIG. 3, the pulley unit 16 includes a hub 22 that is journalled on shaft 17. A pair of outer pulley members 23 and 24 are secured to hub 22 and a central pulley member 25 is slidable on the hub in a direction toward and away from the outer pulley members. The space between outer pulley member 23 and central pulley member 25 defines a diverging groove 26 and similarly the space between the outer pulley member 24 and central pulley member 25, defines a diverging groove 27. As shown in FIG. 3, the belt 15 is received within the groove 26, while a second V-belt 28 is received within the diverging groove 27, and is connected to an upper or output pulley 29 that is mounted on shaft 30. As shown in FIG. 1, the end of shaft 30 carries a flange 32 which is secured to frame 7.

Tension is applied to the belt 28 by a tensioning roller 33, which is engaged with one run of belt 28 as shown in FIG. 2. Roller 33 is mounted for rotation on the upper end of a rod 34, which is pivoted to one of the side plates 19 of carriage 18 at pivot 35. To urge roller 33 into contact with belt 28, a coil spring 36 is connected between the upper end of rod 34, and one of the corner members 8 of the winch frame 7, as shown in FIG. 2. The force of spring 36 will tend to pivot the roller 33 in a clockwise direction as shown in FIG. 2, to tension the belt 28.

By pivoting carriage 18, the belt drive can be moved between an engaged and disengaged condition. In this regard, a yoke 40 is pivotably connected to one of the side plates 19 of carriage 18, and a rod 42 extends upwardly from the yoke and through an opening in the top wall 12 of the winch frame 7. The upper end of rod 42 is connected to a cross pin 44, the ends of which extend through elongated vertical slots 45 in parallel vertical plates 46 that project upwardly from top wall 12.

As best shown in FIG. 4, a curved or arcuate link 47 is also pivotally connected to pin 44 and the upper end of the link extends through an elongated slot in a handle 48 and is pivotably connected to pivot pins 49 which extend outwardly from opposite sides of a nut 50. Pins 49 are mounted for sliding movement within opposed elongated openings 51 in handle 48. Handle 48 is pivoted to plates 46 by pivot shaft 48a. A threaded rod 52 extends through an axial opening in the upper end of handle 48 and is threaded to nut 50. Connected to the upper end of rod 52 is a hand knob 53. By threaded adjustment of the rod 52 through operation of hand knob 53, nut 49 will be moved axially within handle 48, thereby varying the position of the pin 44 due to the connection of link 47 with pins 49 and 44. This will, in turn, vary the pivotal movement of the carriage 18, and will control the output speed to the upper pulley 29.

Carriage 18 is biased downwardly by a spring 54 which interconnects one of the side plates 19 of the carriage and adjusting screw 37.

By pivoting the handle 48 downwardly, rod 42 will move downwardly to thereby pivot the carriage 18 in a downward direction. This action will cause the lower belt 15 to slacken, thus disengaging the drive to the double pulley unit 16. Downward movement of the handle is limited by tautness in the upper belt 28.

When handle 48 is pivoted upwardly, rod 42 will move upwardly, thereby pivoting the carriage 18 upwardly. As the carriage pivots upwardly, belt 15 will become taut and move radially inward of groove 26, thereby moving the central hub 25 of the double pulley unit 16 toward the outer pulley member 24, and causing the belt 28 to move radially outward in pulley groove 27. The radially inward movement of belt 15 within groove 26 in conjunction with the radially outward movement of the belt 28 within groove 27, in effect changes the diameters of the double pulley to vary the output speed to upper pulley 29. In practice, the operator will pivot handle 48 from a full down position where the drive is disengaged to a full up position where the drive is engaged. The adjustment though operation Of hand knob 53 establishes the position of double pulley unit 16 at the full up position, thus setting the driving speed.

Figure 5:
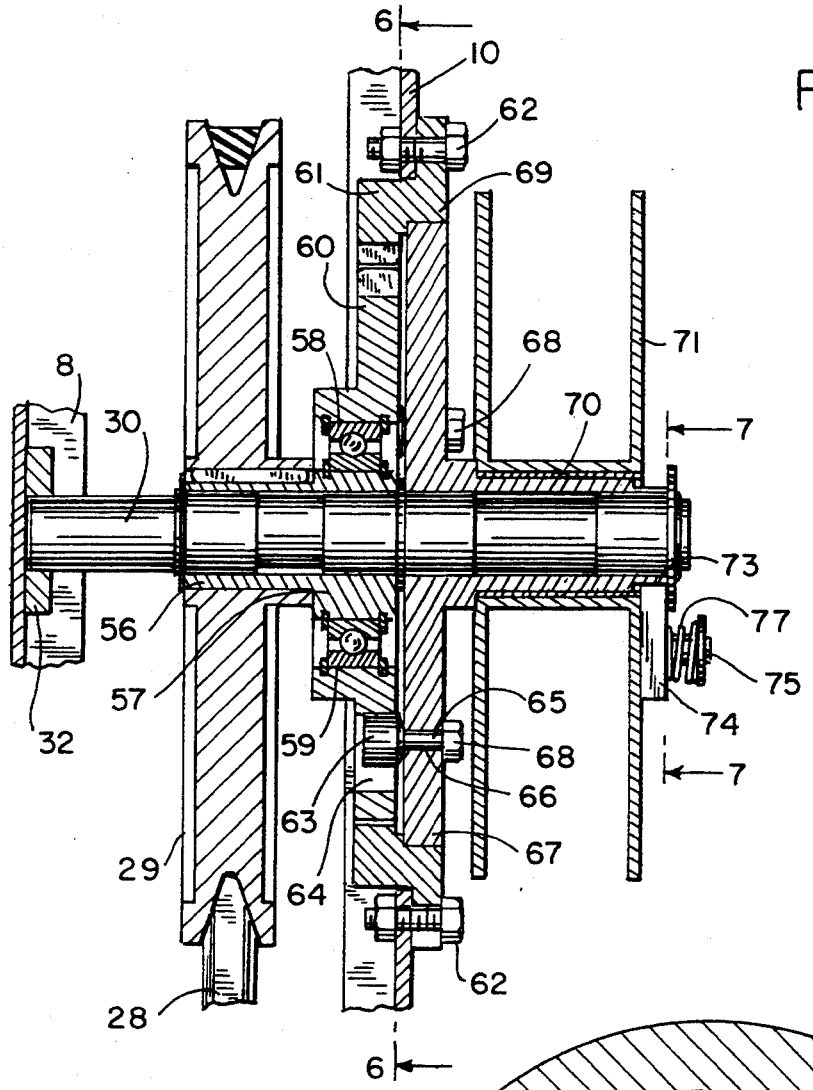
FIG. 5 is a longitudinal section showing the secondary speed reducing mechanism connected to the drum.
Figure 7:
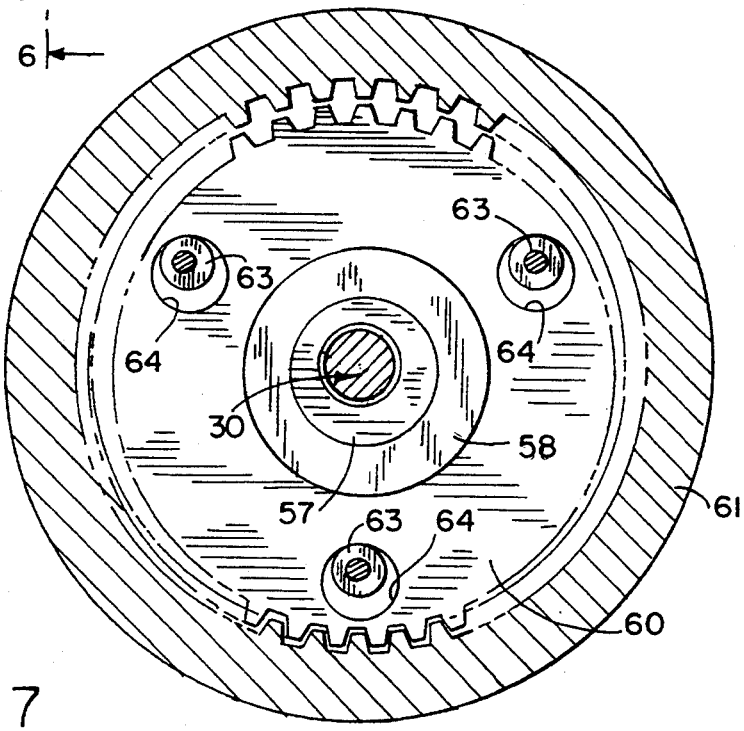
FIG. 7 is a section taken along line 7—7 of FIG. 5.

As seen in FIG. 5, pulley 29 is keyed to the hub 56 of a cam or eccentric 57 that is journalled on shaft 30. Eccentric 55 rotates within a bearing 58 that is mounted within the central opening 59 of a pinion gear 60. Gear 60 is mounted within the central toothed opening of a fixed gear ring 61, and as shown in FIG. 5, the outer diameter of gear 60 is smaller than the internal diameter of the gear ring 61.

The outer periphery of gear ring 61 is secured to front plate 10 of the winch frame 7 through a series of bolts 62.

A follower 63 is remounted within each opening 64 in gear 60. As shown in FIG. 6, three followers 63 and opening 64 are utilized, but it is contemplated that this number can vary. The stem 65 of each follower 63 extends through a hole 66 in plate 67, and a nut 68 is threaded on the end of each stem to lock the follower 63 to the plate 67.

As shown in FIG. 5, plate 67 is located within gear ring 61 and is spaced axially from the gear 60. The periphery of plate 67 is seated against a shoulder 69 in the gear ring 61.

Hub 70 is secured to plate 67 and hub 70 extends through a central opening in cable drum 71 on which a cable 72 is wound. The outer end of hub 70 is provided with a pair of notches 73 and a latch or locking pawl 74 is pivoted to one face of the drum 70 through pin 75. The distal end of pawl 74 is provided with a pair of tips 76, and one of the tips is adapted to engage a notch 73 in the hub end. With the latch 74 engaged with the hub 70, rotation of plate 67 will be imparted to the drum 71. When the pawl 74 is disengaged, drum 71 will rotate freely on the hub, enabling the cable 72 to be pulled from the drum 71 without rotating the drive mechanism.

Pawl 74 is held in position, either engaged or disengaged, with hub 73 by the force exerted by compression spring 77 on the pawl 74 and against the surface of the drum 71.

As shown in FIG. 1, a suitable handle 78 can be secured to the outer face of drum 71 to facilitate playing out or wind-up of the cable 72 when the drum is disconnected from the drive mechanism.

In operation of the screed, the cables 72 are unwound from the cable drums 71 of each winch assembly and the free end of each cable is attached to a stake, or other fixed object located along the side of the concrete slab to be finished. The screed is normally operated in a start and stop manner. With the handle 48 in the down position, the belt 15 will be in a slack condition so that the drive will be disengaged. To begin movement of the screed, the operator pivots the handle 48 upwardly to the full up position, thus engaging the drive and causing the drum 71 to rotate in a direction to wind the cable on the drum and move the screed along the concrete slab. The speed of movement of the screed, when the handle is in the full up position, is established by prior adjustment of the hand knob 53. The speed of movement of the screed is normally established for a given job site depending on the consistency of the concrete and the ambient conditions. Once the speed has been established through adjustment of the hand knob 53 for that particular job site, no further adjustment is made and by moving the handle to the full upright position, memory will be established, so that the screed will move at the same rate of speed.

The belt drive, in combination with the eccentric gear drive, provide a simple, compact, and inexpensive speed reducing mechanism for driving the winch cable drum from the vibratory eccentric shaft. In practice, the eccentric shaft may be rotating at a speed of about 2600 rpm. This speed will be reduced to a value of about 800 rpm at the double pulley unit 16, and the output pulley 29 will be operating at a speed of about 300 rpm. This speed is further reduced by the eccentric gear unit to a speed of about 13 rpm for the cable drum 71.

Various modes of carrying out the invention are contemplated as being within the scope of the following claims particularly pointing out and distinctly claiming the subject matter which is regarded as the invention.

I claim:

1. A winch construction for moving a vibratory screed across a surface to be finished, comprising:

a frame;

a drive shaft mounted for rotation on the frame;

a rotatable drum;

a cable wound on the drum and having a free end to be secured to a fixed object;

a speed reducing unit interconnecting the drive shaft and the drum, said speed reducing unit including a first pulley connected to said drive shaft and a second pulley connected to said drum, said speed reducing unit also including a double pulley unit including a pair of outer pulley members and a central pulley member slidable between said outer pulley members, the space between a first of said outer pulley members and said central pulley member defining a first outwardly diverging groove that constitutes a third pulley and the space between the second outer pulley member and the central pulley member defining a second outwardly diverging groove that constitutes a fourth pulley, a first endless drive belt connecting said first pulley and said third pulley, a second endless belt connecting said second pulley and said fourth pulley, operating means for moving the double pulley unit in a direction toward and away from said first pulley, movement of said double pulley unit toward said first pulley serving to slacken said first belt and disengage the drive and movement of the double pulley unit away from the first pulley serving to engage the drive, and adjusting means for moving the central pulley member toward and away from said second outer pulley member to change the effective diameters of said third and fourth pulleys to vary the speed of rotation of said second pulley and said drum when said drive is engaged.

2. The construction of claim 1, and including resilient tensioning means connected to said second belt for maintaining tension said second belt as said double pulley unit is moved toward and away from said first pulley.

3. The construction of claim 2, wherein said tensioning means comprises a roller disposed to ride against said second belt, and biasing means for biasing said roller towards said second belt to thereby tension said second belt.

4. The construction of claim 1, wherein said operating means for moving the double pulley unit comprises a carriage, said double pulley unit being journaled for rotation on said carriage, and means for mounting the carriage for movement relative to said frame.

5. The construction of claim 4, wherein said means for mounting the carriage comprises a pivotal connection between said carriage and said frame.

6. The construction of claim 5, and wherein said operating means also includes a manually operable handle connected to said carriage for pivoting said carriage.

7. The construction of claim 6, wherein said operating means also comprises a linkage connected to said carriage, said operating handle being pivotally connected to said linkage and having a first position where said first belt is slack to disengage the drive and having a second position where said first belt is taut and said drive is engaged.

8. The construction of claim 7, wherein said adjusting means comprises means for changing the location of the pivotal connection between said linkage and said handle.

9. The construction of claim 2, and including second speed reducing means interconnecting said belt drive unit and said drum.

10. The construction of claim 9, wherein said second speed reducing means comprises an eccentric connected to said belt drive unit, an annular gear connected to said drum and having a central opening to rotatably receive said eccentric, a fixed gear ring having a central aperture to receive said gear, the diameter of said central aperture being greater than the outer diameter of said gear whereby rotation of said eccentric will cause the gear to slowly rotate within said aperture.

11. The construction of claim 10, including a plurality of circularly spaced openings in said gear, a follower mounted for rotation in each opening, an annular plate mounted concentrically of said gear ring, said followers being secured to a face of said plate, a hub connected to said plate, said construction also including connecting means for removably connecting the drum to said hub, disengagement of said connecting means enabling said drum to rotate freely on said hub to thereby play out the cable from said drum.

12. In combination, a vibratory screed including a screed frame, at least one surface working member connected to said screed frame for engaging and finishing a surface, vibratory means including an eccentric shaft for imparting vibrations to said screed frame, a winch frame connected to an end of said screed frame, a first pulley mounted for rotation on said winch frame and operably connected to said eccentric shaft, a second pulley mounted for rotation on the winch frame, a drum mounted for rotation on the winch frame and operably connected to said second pulley, a cable wound on said drum and having a free end to be secured to a fixed object, a carriage mounted for movement on said winch frame, a double pulley unit mounted for rotation on said carriage and including a pair of outer pulley members and a central pulley member mounted for sliding movement in a direction toward and away from said outer pulley members, the space between a first of said outer pulley members and the central pulley member defining a third pulley and the space between the second outer pulley member and the central pulley member defining a fourth pulley, a first belt interconnecting said first pulley and said third pulley, a second belt interconnecting said fourth pulley and said second pulley, operating means for moving the carriage relative to the winch frame, movement of said carriage toward said first pulley causing said first belt to slacken to disengage the drive and movement of said carriage away from said first pulley acting to engage said drive, and resilient belt tensioning means engaged with said second belt for maintaining tension on said second belt as the carriage is moved in said direction.

13. The combination of claim 12, and including adjusting means operably connected to the carriage for adjusting the position of the carriage in said direction when said operating means is in a fixed position to thereby change the effective diameter of said third and fourth pulleys to vary the output speed of said second pulley and said drum.

14. The combination of claim 12, wherein said carriage is pivotally mounted on said winch frame.

* * * * *